United States Patent [19]

Bassinger

[11] Patent Number: 4,844,181

[45] Date of Patent: Jul. 4, 1989

[54] FLOATING SUB

[76] Inventor: Grey Bassinger, 723 W. Dengar, Odessa, Tex. 79705

[21] Appl. No.: 234,338

[22] Filed: Aug. 19, 1988

[51] Int. Cl.[4] ..... E21B 17/07; F16F 9/00

[52] U.S. Cl. ..... 175/195; 175/321; 267/137; 464/20

[58] Field of Search ..... 175/321, 320, 299, 162, 175/195; 267/137, 141.2, 125, 153; 464/20, 18, 180, 245

[56] References Cited

U.S. PATENT DOCUMENTS

| | | | |
|---|---|---|---|
| 4,055,338 | 10/1977 | Dyer | 175/321 X |
| 4,192,155 | 3/1980 | Gray | 175/321 X |
| 4,257,245 | 3/1981 | Toelke et al. | 175/321 X |
| 4,398,898 | 8/1983 | Odom | 175/321 X |
| 4,439,167 | 3/1984 | Bishop et al. | 175/321 X |
| 4,502,552 | 3/1985 | Martini | 175/321 X |
| 4,552,230 | 11/1985 | Anderson et al. | 175/321 |
| 4,759,738 | 7/1988 | Johnson | 175/321 X |

*Primary Examiner*—Stephen J. Novosad
*Attorney, Agent, or Firm*—Marcus L. Bates

[57] ABSTRACT

A drill string is rotated by a top drive system and includes a floating sub which interconnects the upper end thereof with the drill pipe, and a bit at the lower end thereof. The bit is connected to the lower end of the drill pipe by means of a shock absorber. The floating sub prevents vibrational energy from the drill string from damaging the top drive system while the shock absorber prevents vibrational energy from damaging the bit and vice versa.

10 Claims, 2 Drawing Sheets

FLOATING SUB

BACKGROUND OF THE INVENTION

Floating subs are known to those skilled in the art as evidenced by the prior art of record in this patent application. Floating subs are normally placed on a drilling rig between the top drive head and the drill string. The sub's floating or axial slipping motion allows the driller to more confidently manage his drill string by removing feed cylinder and pipe weight forces from thread flanks during make-up or breakout of tool joints. Secondly, a floating sub incorporating an adequately designed shock absorbing element within itself, allows the sub to have the further advantage of eliminating a high percentage of the destructive vibrational forces transmitted to the hydraulic motor and gear box of the drilling rig. These forces are ever present by the very nature of the act of drilling a borehole through various formations no matter what type rotary bit or system is used.

Downhole shock absorbers are known to those skilled in the art. A downhole shock absorber can also reduce some of the harmonic motion transmitted between the drill bit and the drill string. A properly designed shock sub placed directly above a drill bit, directly above a downhole hammer tool, or adjacent to any stabilizers that may be included in the string, is very desirable because it can greatly extend the life of the drill bit as well as the life of the entire tool string. Furthermore, it is not uncommon for this type drill string assembly to also increase penetration rates.

According to the present invention, the use of a floating sub incorporating a shock absorbing element in combination with a top drive system, and a downhole shock sub in combination with a drill bit can be simultaneously employed and thereby obtain results not expected of prior art floating subs and shock absorbers. Accordingly, the present invention provides improvements in a floating sub for a drilling rig. The present invention further comprehends improvements in a shock absorber for use downhole in a drill string. Further, the present invention comprehends the employment of both a floating sub located at the upper end of the drill string and a shock absorber located at the lower end of the drill string. The combination of both a shock absorber and a floating sub, made in accordance with the present invention, has a synergistic effect with respect to wear on a top drive system and rate of penetration of the drill bit.

SUMMARY OF THE INVENTION

This invention comprehends the combination of a top drive system connected to rotate a floating sub located therebelow, said floating sub is connected for rotating a string of drill pipe, said drill pipe being connected to a shock absorber and said shock absorber is connected to rotate a drill bit that is in underlying relationship and in close proximity thereto. The floating sub comprises means for dampening vibrational energy induced into the top drive system by the drill pipe. The shock absorber includes means for dampening vibrational energy that otherwise may be transmitted between the drill bit and the drill string.

Specifically, the floating sub transmits torsional force from the top drive into the drill string while at the same time effects axial sliding movement between the top drive and drill string. More specifically, the floating sub of the present invention comprises an elongated, outer, tubular housing having means forming a connection at the upper end thereof by which it is connected into a drill string; a mandrel in the form of an inner, elongated, tubular housing telescopingly received in sealed relationship respective to said outer housing and terminating in a connection at the lower end thereof by which it can be connected to the upper end of a drill string. The inner and outer housings can reciprocate respective to one another while concurrently being held non-rotatable respective to one another by a spline means. Seal means are spaced from one another with said spline connection being located therebetween for sealing the upper and lower ends of both the inner and outer housings respective to one another.

An axial bore is formed through said floating sub through which drilling fluid can flow. A counterbore is formed in the upper marginal end of said inner annular housing, an annular resilient member is received within said counterbore and having a marginal free end extending above the free end of the inner housing.

Means are provided by which the upper free end of the inner member is restricted in travel to a distance less than the axial length of the counter bore; and stop means by which the free end of the resilient member abuttingly engages the interior of the outer member.

The shock absorber apparatus comprises an elongated, outer, tubular housing having a connection at the upper end thereof by which it is connected into the drill string, and an inner, annular housing telescopingly received within said outer housing and extending therefrom, and having a connection at the lower end thereof by which it can be connected to the drill bit.

A spline connection is formed between said inner and outer housings for telescoping movement thereof while precluding relative rotation therebetween; and seal means is formed between the coacting peripheral surfaces of the inner and outer housing, and are spaced apart from one another with said spline means being located therebetween.

A spring chamber is provided within which a resilient member is stored at a location between the upper terminal end of the inner annular housing and a near face of the outer annular housing. An elongated, longitudinal extending liner having an enlargement at the upper end thereof, and seal means between the enlargement and the wall of the outer housing, is arranged in conjunction with the inner and outer housings to form the spring chamber.

Accordingly, a primary object of the present invention is the provision of a floating sub by which a top drive system is interconnected with a drill string to provide vibration reducing means and for lessening the shock and vibrations transmitted by the drill string into the rotary drilling apparatus.

A further object of the present invention is the provision of a floating sub having shock absorbing characteristics associated therewith that dampens shock and vibrations usually transmitted by the drill string back into the gear box of a top drive system.

Another and still further object of the present invention is the provision of a floating sub having means for lessening shock and vibrations transmitted between the motor or gear box of a top drive system, wherein the floating sub includes improved seal means and shock absorbing means therein that greatly improves the performance of the floating sub while at the same time significantly extends the life of the top drive.

A still further object of the present invention is the provision of an improved shock absorber for lessening shock and vibrations transmitted between the drill bit and drill string of a drilling rig, wherein the shock absorber includes improved seal means and shock absorbing means therein that greatly enhances the performance of the shock absorber while at the same time significantly extends the life of both the shock absorber and the drill bit.

An additional object of the present invention is the provision of a tool string for use in conjunction with a top drive system comprising an above ground floating sub and a below ground shock absorber by which the vibrations induced into the gear box by the drill string are lessened by the floating sub while the vibration imparted into the drill bit by the drill string is lessened by the shock absorber.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
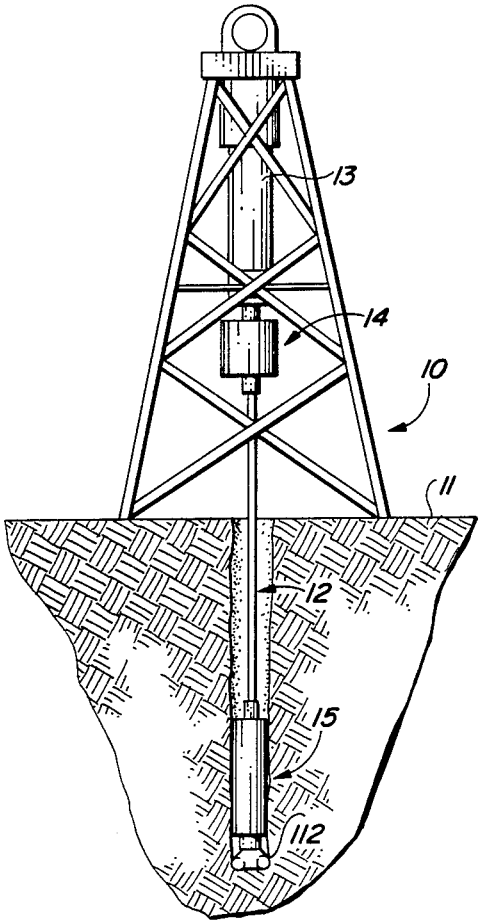
FIG. 1 is a part diagrammatical, part schematical, part cross-sectional view of a drilling rig having apparatus made in accordance with the present invention associated therewith.
Figure 3:
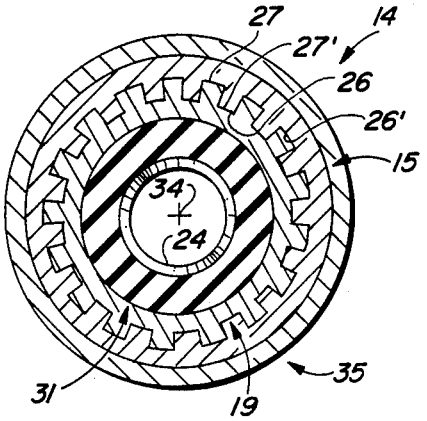
FIG. 3 is a cross-sectional view taken along line 3—3 of FIG. 2.

In FIG. 1 of the drawings, there is disclosed a drilling rig 10 for forming boreholes that extend into the ground 11. The drilling rig is connected for rotating a drill string 12 to which there is attached a drill bit 112. The drilling rig includes a top drive system having a drill motor 13 that may include a gear box connected to a floating sub 14 made in accordance with the present invention. A shock absorber 15 is attached to the lower end of the drill string 12, and the drill bit is attached to the lower end of the shock absorber 15. The details of the floating sub 14 are set forth in the embodiments of the invention disclosed in FIGS. 2–5. The details of the shock absorber 15 are set forth in FIG. 6.

Figure 2:
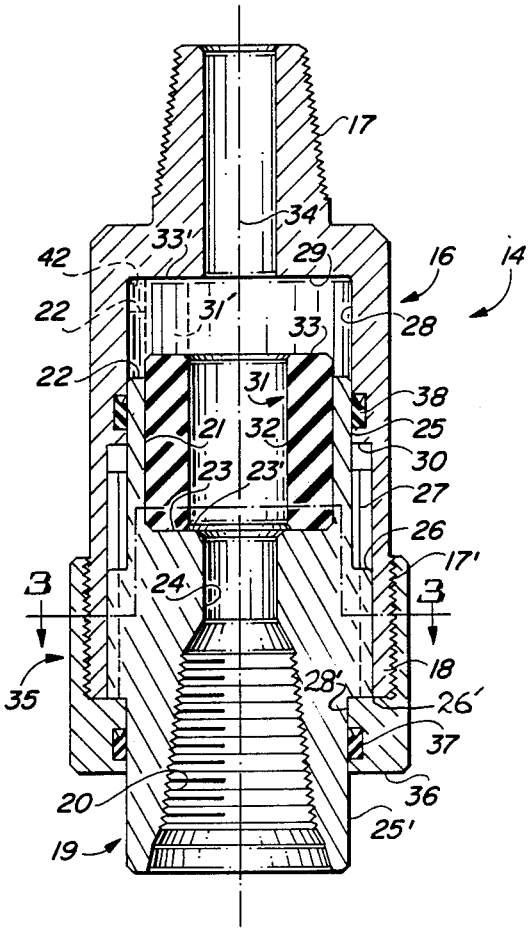
FIG. 2 is an enlarged, longitudinal, cross-sectional, detailed view of part of the apparatus disclosed in FIG. 1.

In FIG. 2, together with other figures of the drawings, there is disclosed the details of the first embodiment of the floating sub 14. The floating sub has an outer, annular, upper body 16 threaded at 17 so that it can be connected into a drill string 12. The upper body 16 has a downwardly depending, circumferentially extending skirt 18 within which there is reciprocatingly received in a telescoping and slidable manner an inner, lower, annular body 19, also referred to herein as a mandrel.

The mandrel or lower annular body 19 is internally threaded at 20 to provide a box connection by which the floating sub 14 can be connected into a drill string. Numeral 21 indicates an axial counterbore formed in the upper marginal end of the annular body 19. The annular body 19 terminates at the upper end thereof in a circumferentially extending annular shoulder 22. The shoulder 22 defines the opening into a counterbore 21 that extends into the lower annular body 19 and terminates at the lower end thereof in an annular shoulder 23. Numeral 23' indicates a circumferentially extending inside edge portion that defines the entrance into a reduced diameter throat 24.

Numerals 25 and 25' each indicates a smooth outside diameter part of the lower annular body 19 which are surfaces that are spaced apart by the illustrated spline connection 26 and 27. That is, the inner surface of the upper annular body and the outer surface of the lower annular body are made into a spline connection at 26 and 27. The spline preferably is of a standard SAE configuration and extends longitudinally as illustrated.

Numeral 28 indicates an inside peripheral wall surface of a working chamber that is formed on the interior of the before mentioned skirt 18. The chamber 28 extends from an upper annular end wall or stop 29 down to a shoulder 30 formed at the beginning or top of the spline 26. Numeral 26' denotes the lower end of the skirt 18, the lower end of the spline 26, and an annular face that abuttingly engages a lower annular face formed at the end of the spline 26.

An annular resilient member 31, made in accordance with the present invention, has an axial, longitudinal passageway 32 formed therethrough and an upper terminal end 33 opposed to a lower terminal end seated at 23. Numeral 34 indicates an axial passageway that lies along an axial centerline that extends longitudinally through the entire floating sub 14; and, it will be noted that all of the component parts of the present invention share the common central axis 34.

Cap 35 has an inwardly directed enlargement at the lower end thereof that terminates in a circumferentially extending shoulder 36. Seal means 37 is received in a groove formed within the enlargement of the cap and thereby seals the interface between surface 25' and the central bore of the cap enlargement 36'. Seal 38 is received within a groove formed in the wall 36' and seals the interface between the inner surface 28 of the outer housing and outer surface 25 of the inner housing. The seals, 37 and 38, preferably are unidirectional and oriented as illustrated for reasons which will be more particularly pointed out later on in this disclosure.

The embodiment of the invention set forth in FIG. 2 comprises three major steel components 16, 19, and 35; one resilient annular member 31; and two seals 37 and 38. The components are assembled in the illustrated manner of FIGS. 2 and 3 whereby none of the parts can possibly fall downhole into the borehole. Specifically, the distance between the confronting shoulders 22 and 29, along with the diameter of the bore 21, the lower shoulder 23, and the length of the resilient member 31 precludes the resilient member 31 becoming dislodged from counterbore 21 and disrupting the drilling operation, noting that the length of the member 31 is such that it can be removed from the bore 21 only when the apparatus is disassembled. Furthermore, unexpected results are achieved from this unusual arrangement of the coacting parts of the floating sub.

Figure 4:
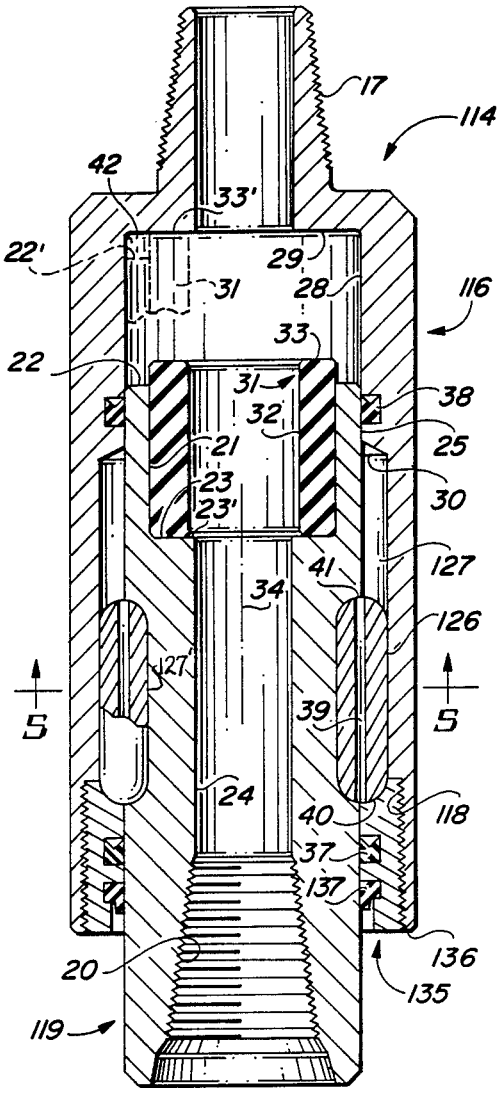
FIG. 4 is a longitudinal, part cross-sectional, detailed view of another embodiment of the apparatus disclosed in FIG. 2.

'In the embodiment of the invention set forth in FIG. 4, wherein like or similar numerals are used to indicate like or similar elements, there is disclosed a floating sub 114 having an upper annular body 116 and a lower annular body 119 connected together for axial movement by means of the special spline connection seen illustrated at 126. upper, outer, annular body 116 has a plurality of elongated, semi-circular slots 127 formed therein that coact with the illustrated semi-circular slots formed within the lower, inner, annular body. The cylindrical members 126 preferably are each provided with a passageway 39 formed axially therethrough so that fluid can be transferred from one side 41 of the spline chamber 127 through the passageway 39 of the members 126, and into the other end of the spline chamber at 40.

The circumferentially spaced grooves of the lower annular member 119 is curved at opposed ends thereof as indicated by numerals 40 and 41. The closure member 135 is also curved at 40.

Accordingly, the plurality of cylindrical members 126 are seated within a plurality of complementary close tolerance grooves, and must therefore rotate concurrently with axial movement between the upper and the lower annular members. The grooves 127 formed within the upper annular member are extended longitudinally and placed concentrically about the central axis so that relative movement between the lower and upper annular members moves the cylindrical spline members 126 therewith within a range that is near the upper end 30 of groove 127 to the lower end 40 thereof.

Closure member 135 is threadedly received by the lower marginal end of the circumferentially extending skirt of the upper annular member. The threads extend from the lower end 136 of the skirt up to a location at 118. A wiper ring 137 is placed below the seal 37. Seal 38 cooperates with the upper and lower annular members in the same manner of the embodiment of FIG. 2.

The free end 33 of the resilient annular member 31 abuttingly engages end wall 29 when the member 31 is moved into position 33'. At this time, member 22 is moved into position 22' thereby forming an isolated chamber 42 at the upper end of the chamber. Hence, there is an isolated annular chamber 42 formed within the chamber defined by walls 28 and 29.

In the embodiment of FIGS. 2 and 4, when the string 12 is in tension the tools are oriented in the position illustrated in the drawings, and the pin end 17 is carrying the load that is connected at box end 20. The weight of the string forces the confronting faces of the enlargement and cap at 26' to bear against one another, and the threaded area of the cap transfers the load into the upper annular member where the load is then transferred by means of pin end 17 into the top drive system.

When the weight is set down on the bit, or when the string is in compression, the pin end 17 forces the upper annular member downhole so that the resilient annular member 31 moves into the illustrated position 33' thereby cushioning the vibratory energy between the drill string and the top drive system, or between the pin and box ends 17, 20 of the floating sub. It is important to assure that the annular face 22 of the inner annular member and the face 33 of the resilient annular member 31 be arranged as illustrated to provide a chamber 42, and to enable member 22 to abut wall 29 when the member 32 is unduly compressed.

The spline chamber 27 is filled with lubricant. As the upper and lower annular members reciprocate respective to one another, an exchange of fluid contained within spline chamber 27 must occur across the spline connection 26, 26', that is, from 27 to 26', or vice versa. The seals 37, 38 isolate the spline chamber and therefore prevent loss of fluid therefrom. When the pin and box ends reciprocate towards one another, fluid pressure is exerted above 26 while reduced pressure is effected at 26' causing the fluid to flow from one side of the spline chamber to the other. The reduced pressure is of insufficient magnitude to allow debris to flow across seal 37 and the increased pressure is insufficient for flowing across lubricant seal 38; that is, the design of the seals preclude pumping of the lubricant from the spline chamber.

The pressure effected within the axial passageway 34 and through the tool is effected on seal 38 while the seal 37 is subjected to pressure effected within the borehole annulus. For this reason, the seals are oriented in the above described manner to seal against this pressure. Since the chamber 27 is completely filled with a liquid lubricant and is thereby incompressible, as the pressure increases at 34, seal 38 prevents passage of fluid thereacross.

Figure 5:
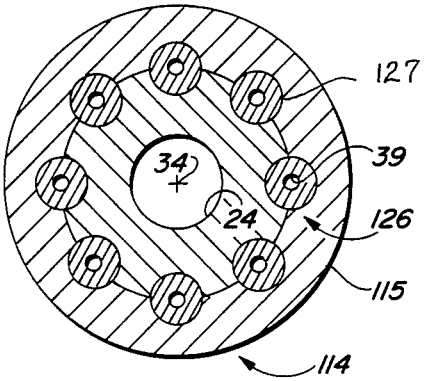
FIG. 5 is a cross-sectional view taken along line 5—5 of FIG. 4.
Figure 6:
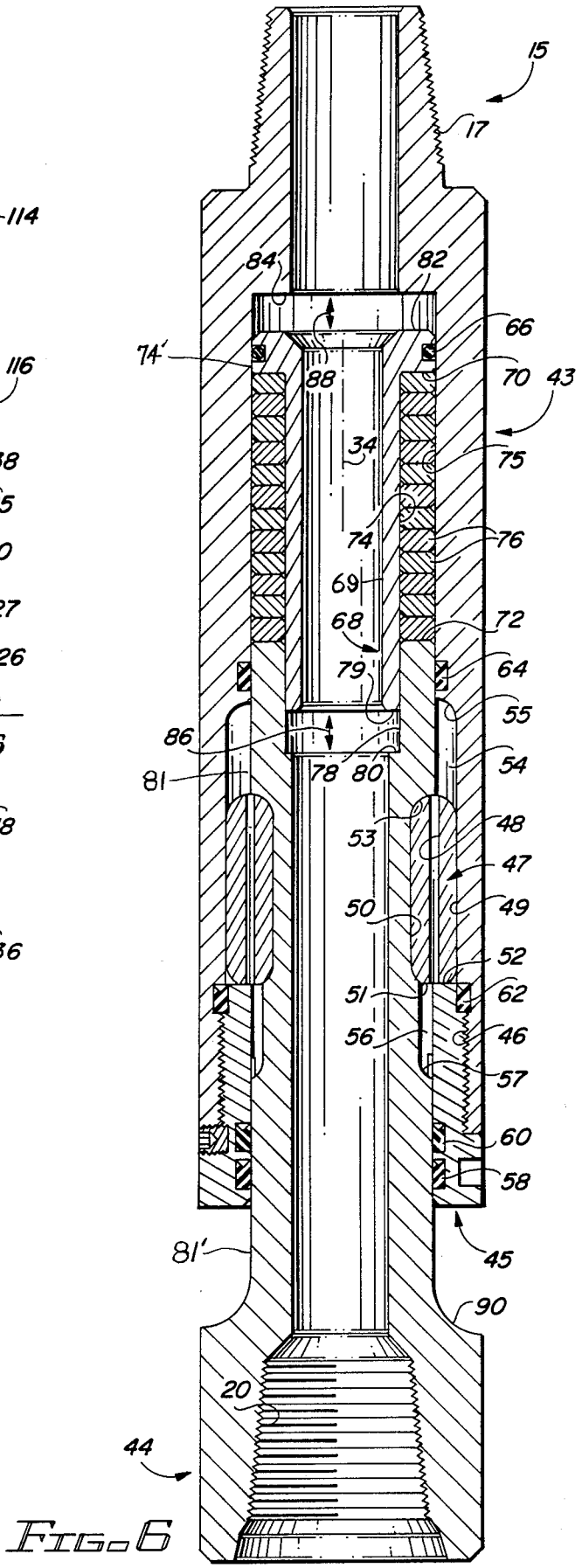
FIG. 6 is a enlarged, longitudinal, cross-sectional, detailed view of another part of the apparatus disclosed in FIG. 1.

It should be noted that FIG. 5 represents a cross-sectional view as may be taken across 3—3 in FIG. 2 as well as across the spline chamber of FIG. 6. In FIG. 6, the downhole shock absorber 15 is provided with a pin end 17 at the upper end thereof and a box end 20 at the opposed end thereof. The pin end forms part of an outer annular member 43 while the box end forms part of an inner annular member 44. The pin and box ends can be reversed if desired. Numeral 45 indicates an end cap that forms a sealed closure member for threadedly engaging the outer annular member at 46.

A plurality of load transferring cylinders 47, each having a passageway 48 formed longitudinally therethrough, are received within a plurality of circumferentially extending grooves 50 and 49 that jointly form a spline chamber. FIG. 5 shows one preferred arrangement of the outer grooves 49, the inner grooves 50, and the cross-sectional configuration of the individual cylindrical members 47. The numerology of FIGS. 5 and 6 is not consistent with each other.

End 51 of the member 47 abuttingly engages face 52 of the end cap 45. The other end of member 47 abuttingly engages the groove 53 formed in the inner annular member 44. Numeral 54 indicates the working chamber within which the members 47 are slidably received in a reciprocating manner. Member 55 indicates a curved member that does not normally abuttingly engage the upper end of member 47. Numerals 56 and 57 illustrate a reduced annular chamber that is in communication with the spline chamber and forms a storage area for lubricant.

Seals 58, 60, 62, 64, and 66 are axially spaced apart from one another and concentrically arranged along the longitudinal axial centerline of the apparatus 15. Dual seals 58, 60 are provided between the inner annular member and the inner wall surface of the cap 45. Seal 62 precludes leakage along the threaded surface 46. Seal 64 prevents flow of fluid along the interface formed between the inner annular member 44 and the inside surface of the outer annular member 43.

Annular spring assembly 68 includes a sleeve member 69 which extends from an enlargement formed at the upper end thereof, and which receives an o-ring 66 about the major diameter thereof. Members 69, 43, and 44 provide opposed wall surfaces 70, 72 that confront one another and concentric wall surfaces 74, 75 that are spaced from one another and thereby jointly form a spring chamber within which there is stored a plurality of resilient rings 76. Enlarged inside diameter 78 of the marginal end of the inner annular member reciprocatingly receives member 69 of the spring assembly 68, with the lower end 79 thereof being spaced to avoid abuttingly engaging shoulder 80 that is formed interiorly of member 44. Upper annular face 82 of member 68 abuttingly engages the confronting face 84 of member 43.

Numerals 86 and 88 illustrate the relative movement of member 68 respective to members 80, 84. Member 44 is enlarged at radius 90 to accommodate formation of the box end.

In operation of the apparatus disclosed in FIGS. 2–5, the box and pin ends, by which the apparatus is connected into the drill string, can be interchanged; that is, a box end can be formed at 17 while a pin end is formed at 19; and, conversely, the apparatus can be inverted, as may be desired. The apparatus preferably is directly connected immediately below the top drive system 13 and the top drive system lowered until the weight of the drill string places the resilient annular member 31 in compression, as indicated by the dot-dash numerals 31', 33'.

Seals 37 and 38 are made of equal diameter by making surfaces 25, 25' of substantial identical diameters which require that the inside surfaces 28 and 28' also be of substantial equal diameter. This important feature of the invention brings about unexpected results and advantages over the prior art.

In the embodiment of the invention set forth in FIG. 6, the tool can be inverted as may be desired, and the pin and box ends can be interchanged as may be desired. The multiplicity of resilient elements 76 can be any number of suitable elastomeric annular members but preferably is selected from commercially available metallic wire mesh spacers or alternatively Bellville type spring washers.

The inside diameter 75 of the axial bore of the elongated, outer, annular housing 43 is equal to the outside diameter 74' of the inner sleeve member 68, and also the outside diameter 81 of the inner member 44.

As the weight on the bit increases, the outer housing 43 moves downhole until the confronting faces 82, 84 abut one another and compress the resilient members 76 contained within the spring chambers. The resilient members are captured within the variable spring chamber formed between the coacting surfaces 70, 74, 75, and 72. The spline connection that is formed between the rollers 47 and the semi-circular grooves permit relative axial movement between the inner and outer annular housings while preventing relative rotation therebetween and accordingly, torque exerted by the upper part of the drill string is transferred into the bit by means of the inner annular member 44.

During the drilling process, the rotating drill string encounters the wall surface of the borehole and this imparts vibratory motion into the string. The drill bit, while penetrating various different formations, likewise generates tortional and vibrational energy. The forces generated by these two members is dampened by the present invention.

There is a cooperative action between the floating sub 14 and the shock absorber 15. Specifically, the floating sub 14 isolates the top drive system from the drill string, thereby elongating the life of the top drive system. Moreover, floating sub 14 isolates the drill string 12 from vibrational motion induced by the top drive system 13 thereby elongating the life of the drill string. Further, the shock absorber 15 isolates the bit 112 from vibrational energy induced into the drill string 12, and thereby elongates the life of the bit.

This cooperative action provides a new combination that includes a top drive system, floating sub, drill string, shock absorber, and drill bit.

I claim:

1. Drilling apparatus comprising, in combination, a top drive system, a floating sub, a drill pipe, a shock absorber, and a drill bit;

means connecting said top drive to rotate said floating sub which is located therebelow, said floating sub is connected for rotating said string of drill pipe, said drill pipe being connected to said shock absorber, and said shock absorber is connected to and is located in close proximity to said drill bit;

said floating sub comprises means for dampening vibrational energy induced into the top drive system by the drill pipe, and includes an upper annular housing having a connection at an upper end thereof connected to the drive system and a lower annular housing having a marginal end received within a marginal end of the upper annular housing, and a connection at a lower end of the lower annular housing connected to the upper end of the drill pipe; an axial passageway formed through said floating sub through which drilling fluid can flow to said bit;

said shock absorber includes means for dampening vibrational energy introduced by the drill pipe into the drill bit, comprising an outer housing having a connection at the upper end thereof by which it is connected into a drill string, and an inner housing telescopingly received within said outer housing and extending therefrom, and having a connection at the lower end thereof by which it can be connected to a drill bit;

a spline connection formed between said inner and outer housings for telescoping movement thereof while precluding relative rotation therebetween;

seal means formed between the coacting peripheral surfaces of the inner and outer housing, spaced apart from one another with said spline means being located therebetween;

a spring chamber located between the upper terminal end of the lower annular housing and the lower terminal end of the outer annular housing; resilient biasing means in said spring chamber for biasing said annular members apart to thereby absorb vibrational energy induced into the drill string.

2. The combination of claim 1 wherein said floating sub includes a spline means by which the inner and outer housings can reciprocate respective to one another while concurrently being held non-rotatable respective to one another;

seal means spaced from one another with said spline connection being located therebetween for sealing the upper and lower ends of both the inner and outer housings respective to one another;

an axial bore formed through said floating sub, a counterbore formed in the upper marginal end of said inner housing, an annular resilient member received within said counterbore and having a marginal free end extending above the free end of the inner housing;

stop means formed on said outer housing by which the upper free end of the inner member is restricted in travel to a distance less than the axial length of the counterbore;

and stop means by which the free end of the resilient member abuttingly engages the interior of the outer member.

3. The combination of claim 2 wherein said spline connection is a plurality of cylindrical members received within a plurality of grooves formed within the inner and outer housings.

4. The combination of claim 1 wherein said shock absorber apparatus comprises an elongated, outer, tubular housing having a pin connection at the upper end thereof by which it is connected into a drill string, and an inner, annular housing telescopingly received within said outer housing and extending therefrom, and having a box connection at the lower end thereof by which it can be connected to a drill bit;

said spline connection is jointly formed on said inner and outer housings, and said a spring chamber is located above said spline connection; said spring chamber includes an elongated, longitudinal extending linear having an enlargement at the upper end thereof, seal means between the enlargement and the wall of the outer member, the enlargement having a face that confronts a face on said outer member.

5. A floating sub by which a top drive system is connected to the upper end of a drill string comprising an elongated, outer, tubular housing having means forming a connection at the upper end thereof by which can be connected to a drive system; an inner, elongated, tubular housing telescopingly received in sealed relationship respective to said outer housing and terminating in a connection at the lower end thereof by which it can be connected to the upper end of a drill string;

spline means by which the inner and outer housings can reciprocate respective to one another while concurrently being held non-rotatable respective to one another;

seal means spaced from one another with said spline connection being located therebetween for sealing the upper and lower ends of both the inner and outer housings respective to one another and thereby isolate the spline connection;

an axial bore formed through said floating sub, a counter-bore formed in the upper marginal end of said inner annular housing, an annular resilient member received within said counterbore and having a marginal free end extending above the free end of the inner housing;

stop means associated with said outer annular housing by which the upper free end of the inner annular housing is restricted in travel to a distance less than the axial length of the counterbore;

whereby the free end of the resilient member abuttingly engages said stop means of the outer housing.

6. The floating sub of claim 5 wherein said annular resilient member is longer than said counterbore, and said counterbore is longer than the distance between the stop means and the upper terminal end of the inner housing, and said seal diameters are equal to one another.

7. The floating sub of claim 5 wherein said spline means is a plurality of cylindrical members received within a plurality of complementary grooves formed within said inner and outer annular housings.

8. A shock absorber apparatus for connection into a drill string adjacent to a drill bit, comprising: an elongated, outer, tubular housing having means forming a connection at the upper end thereof by which it can be connected to a drill pipe, and, an inner, annular housing having a marginal end thereof telescopingly received within said outer housing and extending therefrom, the inner housing having means forming a connection at the lower end thereof by which it can be connected to support a drill bit;

means forming a spline connection between the inner housing and the outer housing for relative reciprocating movement in a telescoping manner therebetween while precluding relative rotational motion there between; means forming an axial passageway through said shock absorber through which fluid can flow; a counterbore is formed into said outer housing that terminates in an annular face;

said inner housing and said outer housing having coacting peripheral surfaces that include said spline connection; said inner housing and said outer housing having axially aligned, spaced apart upper and lower seal means formed therebetween, with said spline connection being located between said upper and lower seal means and thereby forming a spline chamber between said seal means;

a variable, annular spring chamber located between an upper terminal end of the inner annular housing and the outer housing annular face, with an upper marginal length of the outer annular housing forming an outer wall surface of said spring chamber; an elongated, longitudinally extending liner having an enlargement at the upper end thereof and forms an inner wall surface of said spring chamber, the enlargement having an upper face that confronts the annular face formed at the upper end of the counterbore, said liner has a lower marginal end slidably received within the interior of the inner housing and an upper marginal end slidably received within the interior of the outer housing; said liner, together with said upper marginal end of the outer housing, forms said variable spring chamber therebetween; said spring chamber has an annular resilient element stored therein that resiliently transfers a force from the outer housing into the inner housing;

said seal means are equal in diameter and are unidirectional, one of said seal means is oriented to admit flow to said spline chamber while the other seal means is oriented to admit flow from said spline chamber; whereby fluid pressure is effected on the spline chamber while going into the hole and fluid pressure is released from the spline chamber while coming out of the hole due to the flow path into and away from the spline chamber provided by the oriented unidirectional spaced seal means.

9. The shock absorber of claim 8 wherein said spline connection is a plurality of cylindrical members received within a plurality of grooves formed within the inner and outer housings, said cylindrical members and said grooves are arranged respective to said annular spring chamber whereby transfer of the weight of the string onto the bit when the string is lowered to bring the bit into contact with the borehole bottom forces the upper face of said enlargement to extend into abutment with the annular face of the counterbore while at the same time the lower end of the liner is brought into abutment with the inner housing and thereby limits the force exerted against the annular resilient element.

10. The shock absorber of claim 8 wherein said spline chamber is isolated from the interior and exterior of the tool by said upper and lower seal means until a pressure differential across the seal means increases to a value that admits equalization of pressure thereacross.

* * * * *